US010005971B2

(12) United States Patent
Dindi et al.

(10) Patent No.: US 10,005,971 B2
(45) Date of Patent: Jun. 26, 2018

(54) GAS OIL HYDROPROCESS

(71) Applicant: E I DU PONT DE NEMOURS AND COMPANY, Wilmington, DE (US)

(72) Inventors: Hasan Dindi, Wilmington, DE (US); Thanh Gia Ta, New Castle, DE (US); Vincent Adam Kuperavage, Jr., Philadelphia, PA (US); Alan Howard Pulley, Lee's Summit, MO (US); Scott Louis Webster, Artesia, NM (US)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 0 days. days.

(21) Appl. No.: 15/444,363

(22) Filed: Feb. 28, 2017

(65) Prior Publication Data

US 2017/0166823 A1 Jun. 15, 2017

Related U.S. Application Data

(63) Continuation of application No. 14/481,952, filed on Sep. 10, 2014, now Pat. No. 9,617,485.

(60) Provisional application No. 61/881,597, filed on Sep. 24, 2013.

(51) Int. Cl.
*C10G 65/12* (2006.01)

(52) U.S. Cl.
CPC ..... *C10G 65/12* (2013.01); *C10G 2300/1059* (2013.01); *C10G 2300/802* (2013.01)

(58) Field of Classification Search
CPC ..... C10G 65/12
See application file for complete search history.

(56) References Cited

U.S. PATENT DOCUMENTS

| | | | | |
|---|---|---|---|---|
| 3,328,290 | A | 6/1967 | Hengstebeck | |
| 3,620,962 | A | 11/1971 | Pfefferie | |
| 4,501,653 | A | 2/1985 | Hanmer | |
| 6,123,835 | A | 9/2000 | Ackerson et al. | |
| 7,569,136 | B2 | 8/2009 | Ackerson et al. | |
| 2009/0321310 | A1* | 12/2009 | Kokayeff | C10G 65/02 208/49 |
| 2012/0074038 | A1* | 3/2012 | Petri | C10G 65/10 208/59 |
| 2012/0080288 | A1 | 4/2012 | Petri et al. | |
| 2012/0080356 | A1 | 4/2012 | Petri et al. | |
| 2012/0205285 | A1 | 8/2012 | Dindi et al. | |
| 2012/0273390 | A1 | 11/2012 | Dindi et al. | |
| 2014/0124407 | A1 | 5/2014 | Dindi et al. | |
| 2014/0124409 | A1 | 5/2014 | Dindi et al. | |

FOREIGN PATENT DOCUMENTS

| | | | |
|---|---|---|---|
| WO | 2006065643 | A2 | 6/2006 |
| WO | 2008083094 | A1 | 7/2008 |

OTHER PUBLICATIONS

Pereira, Mild Hydrocracking using IsoTherming Technology, Dupont Engineering Technology, 2008 annual Meeting of the NPRA, San Diego, CA, Mar. 10, 2008.
Isocracking, Lummus Technology, (2009).
Topsoe Hydrocracking Processes, Haldor Topsoe, (2010).
PCT International Search Report and Written Opinion for International Application No. PCT/US2014/056868 dated Mar. 26, 2015.
Amerada Hess, Material Safety Data Sheet Light Cycle Oil, Feb. 23, 2000.
Tesoro, Safety Data Sheet—Cycle Oil, Light, Nov. 26, 2012.

* cited by examiner

*Primary Examiner* — Randy Boyer

(57) ABSTRACT

A process for the hydroprocessing of a gas oil (GO) hydrocarbon feed to provide high yield of a diesel fraction. The process comprises a liquid-full hydrotreating reaction zone followed by a liquid-full hydrocracking reaction zone. A refining zone may be integrated with the hydrocracking reaction zone. Ammonia and other gases formed during the hydrotreatment are removed in a separation step prior to hydrocracking.

17 Claims, 4 Drawing Sheets

GAS OIL HYDROPROCESS

CROSS-REFERENCE TO RELATED APPLICATION

This application is a Continuation of application Ser. No. 14/481,952 filed Sep. 10, 2014 which claims priority of U.S. Patent Application 61/881,597 filed Sep. 24, 2013, the contents of both applications are incorporated herein by reference in their entirety for all purposes.

BACKGROUND

Field of the Disclosure

The present invention relates to a process for hydroprocessing a hydrocarbon feed and more particularly to a process for hydroprocessing a gas oil hydrocarbon feed.

Description of Related Art

Global demand for diesel has risen quickly with increased growth of transportation fuels. At the same time, regulations on the properties of the transportation diesel have become more rigorous in order to mitigate environmental impact. European standard Euro IV (EN590:1993) for diesel fuel set a maximum density of 860 kilograms per cubic meter ($kg/m^3$). More recently, under Euro V (EN 590:2009) the maximum density was reduced to 845 $kg/m^3$. Other properties for transportation diesel include a polycyclic aromatics content of less than 11 wt % and, under Euro IV, a sulfur content of less than 20 part per million by weight (wppm), reduced to 10 wppm under Euro V, which is sometimes referred to as ultra-low-sulfur-diesel, or ULSD.

Refineries produce a number of hydrocarbon products having different uses and different values. It is desired to reduce production of, or upgrade, lower value products to higher value products. Lower value products include gas oils. Gas oils have historically been used as feedstocks for producing higher grade (value) refinery products. Such oils cannot be directly blended into today's transportation fuels (gasoline and diesel fuel pools) because their high sulfur content, high nitrogen content, high aromatics content (particularly high polyaromatics), high density, and low cetane value do not meet government standards for the United States and European countries.

In addition, when gas oils are used as feedstocks for producing diesel fuel, yield of diesel range product is less than desired. Nonetheless, it is desired to use gas oil as a feedstock to produce diesel fuel, including ULSD.

Various hydrotreating methods, such as hydrodesulfurization and hydrodenitrogenation, can be used to remove sulfur and nitrogen from a hydrocarbon feed. Hydrocracking can be used to crack heavy hydrocarbons (high density) into lighter products (lower density) with hydrogen addition. However, high nitrogen content can poison a zeolitic hydrocracking catalyst, and hydrocracking conditions which are too severe can cause the formation of significant amounts of naphtha and lighter hydrocarbons which are considered lower value products than transportation fuels.

Conventional hydroprocessing units used for hydrotreating and hydrocracking have three-phase (trickle bed reactors) which require hydrogen from a vapor phase to be transferred into liquid phase where it is available to react with a hydrocarbon feed at the surface of the catalyst. These units are expensive, require large quantities of hydrogen, much of which must be recycled through expensive hydrogen compressors, and result in significant coke formation on the catalyst surface and catalyst deactivation.

U.S. Pat. No. 6,123,835, discloses a two-phase ("liquid-full") hydroprocessing system having a liquid-full reactor which avoids some of the disadvantages of trickle bed systems.

U.S. Patent Application Publication 2012/0205285 discloses a two-stage hydroprocessing process for targeted pretreatment and selective ring-opening in liquid-full reactors with a single recycle loop to convert heavy hydrocarbons and light cycle oils to liquid product having over 50% in the diesel boiling range.

U.S. Patent Application Publications US 2012/0080288 A1 and US 2012/0080356 A1 disclose an apparatus and a process, respectively, for hydroprocessing a hydrocarbon feedstock with hydrogen in a first and second hydroprocessing zones wherein the effluent from the first hydroprocessing zone is fractionated on a first side of a dividing wall fractionation column to provide a diesel stream and wherein at least a portion of the diesel stream is the feed to the second hydroprocessing zone. Thus, a diesel fraction is further subjected to hydrogen, increasing yield of lower boiling fractions, such as naphtha, while reducing diesel yield.

Still, it is desirable to provide hydroprocessing systems which convert heavy hydrocarbon feeds, in particular gas oils, to diesel in higher yield and/or quality.

BRIEF SUMMARY OF THE DISCLOSURE

The present disclosure provides a process for hydroprocessing a gas oil. The process comprises: (a) contacting a gas oil with hydrogen and optional first diluent to form a first liquid feed wherein hydrogen is dissolved in the first liquid feed; (b) contacting the first liquid feed with a first catalyst in a liquid-full hydrotreating reaction zone to produce a first effluent; (c) optionally recycling a portion of the first effluent for use as all or part of the first diluent in step (a); (d) in a separation zone, separating dissolved gases from the portion of the first effluent not recycled in step (c) to produce a separated product; (e) contacting the separated product with hydrogen and optional second diluent to form a second liquid feed, wherein hydrogen is dissolved in the second liquid feed; (f) contacting the second liquid feed with a second catalyst in a liquid-full hydrocracking reaction zone to produce a second effluent; (g) optionally recycling a portion of the second effluent for use as all or part of the second diluent in step (e); and (h) in a refining zone upstream of or downstream from the hydrocracking reaction zone, separating one or more refined products and a heavy oil fraction from (1) the portion of the first effluent not recycled, when the refining zone is upstream of the hydrocracking reaction zone, or (2) the portion of the second effluent not recycled when the refining zone is downstream from the hydrocracking reaction zone; wherein the first catalyst is a hydrotreating catalyst and the second catalyst is a hydrocracking catalyst.

The process of the present disclosure advantageously converts gas oil to a diesel fraction in high yield. A smaller yield of a naphtha fraction may be produced. The diesel thus made is of high quality and well suited for use in applications where physical property requirements are strict, such as transportation fuels.

BRIEF DESCRIPTION OF THE FIGURES

Embodiments are illustrated in the accompanying figures to improve understanding of concepts as presented herein.

Figure 1:
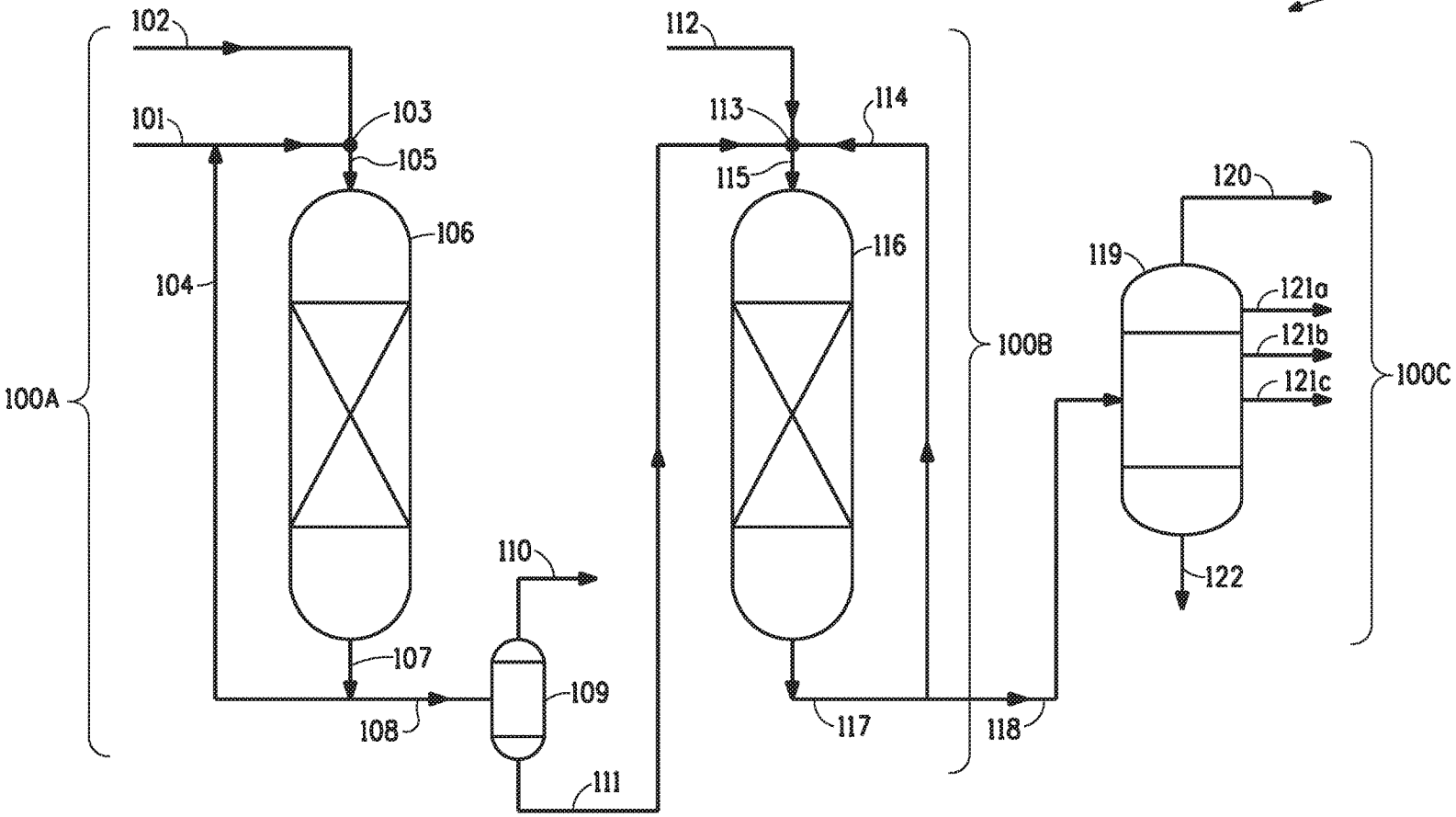
FIG. 1 is a schematic drawing of one embodiment according to the present disclosure having a hydrotreating reaction zone, a hydrocracking reaction zone and a refining zone wherein the refining zone is downstream from the hydrocracking reaction zone.

Skilled artisans appreciate that objects in the figures are illustrated for simplicity and clarity and have not necessarily been drawn to scale. For example, the dimensions of some of the objects in the figures may be exaggerated relative to other objects to help to improve understanding of embodiments.

DETAILED DESCRIPTION

The foregoing general description and the following detailed description are exemplary and explanatory only and are not restrictive of the invention, as defined in the appended claims. Other features and benefits of any one or more of the embodiments will be apparent from the following detailed description, and from the claims.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Unless otherwise defined, all technical and scientific terms used herein have the same meaning as commonly understood by one of ordinary skill in the art to which this invention belongs. In case of conflict, the present specification, including definitions, will control. Although methods and materials similar or equivalent to those described herein can be used in the practice or testing of embodiments of the present invention, suitable methods and materials are described below. In addition, the materials, methods, and examples are illustrative only and not intended to be limiting.

When an amount, concentration, or other value or parameter is given as either a range, preferred range or a list of upper preferable values and/or lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range.

Before addressing details of embodiments described below, some terms are defined or clarified.

The term "amorphous", as used herein, means that there is no substantial peak in a X-ray diffraction pattern of the subject solid.

The term "an elevated temperature", as used herein, means a temperature higher than the room temperature.

The term "hydrotreating" refers to a process in which a hydrocarbon feed reacts with hydrogen, in the presence of a hydrotreating catalyst, to hydrogenate olefins and/or aromatics and/or remove heteroatoms. Thus, hydrotreating may include, for example, hydrogenation, hydrodesulfurization (removal of sulfur), hydrodenitrogenation (removal of nitrogen, also referred to as hydrodenitrification), hydrodeoxygenation (removal of oxygen), hydrodemetallation (removal of metals). When the hydrocarbon feed contains two or more of olefinic, aromatic and heteroatom components, multiple hydrotreating processes may be performed.

The term "hydrocracking" refers to a process in which a hydrocarbon feed reacts with hydrogen, in the presence of a hydrocracking catalyst, to break carbon-carbon bonds and form hydrocarbons of lower average boiling point and/or lower average molecular weight than the average boiling point and average molecular weight of the hydrocarbon feed. Hydrocracking may also include ring opening of naphthenic rings into more linear-chain hydrocarbons.

The term "polyaromatic(s)" refers to polycyclic aromatic hydrocarbon(s) and includes molecules with two or more fused aromatic ring such as, for example, naphthalene, anthracene, phenanthracene and so forth, and derivatives thereof.

The term "yield of the diesel fraction", as used herein, means the weight percentage of the diesel fraction compared to the total weight of the naphtha fraction, the diesel fraction and the heavy oil fraction from the refining zone.

The term "yield of the naphtha fraction", as used herein, means the weight percentage of the naphtha fraction compared to the total weight of the naphtha fraction, the diesel fraction and the heavy oil fraction from the refining zone.

In the process of this disclosure a hydrocarbon feed is treated in a hydrotreating reaction zone. The hydrocarbon feed is a gas oil. Table 1 below provides properties of a gas oil suitable for the processes of this disclosure.

TABLE 1

Properties of a Gas Oil

| Property | Unit | Value |
|---|---|---|
| Sulfur | wppm | 500-20000 |
| Nitrogen | wppm | 1000-2000 |
| Density at 15.6° C. (60° F.) | g/ml | 0.85-0.95 |
| API Gravity | | 35-17 |
| Total Aromatic | wt % | 25-50 |

TABLE 1-continued

| Properties of a Gas Oil | | |
|---|---|---|
| Compounds | | |
| Boiling Point Distribution | | |
| | Simulated Distillation, wt % | ° C. (° F.) |
| IBP = Initial boiling point | IBP | 200-300 (400-550) |
| | 5 | 250-350 (500-650) |
| | 10 | 300-375 (550-700) |
| | 50 | 350-425 (650-800) |
| | 90 | 375-500 (700-950) |
| FBP = Final boiling point | FBP | 425-650 (800-1200) |

The present disclosure provides a process for hydroprocessing a gas oil. The process comprises: (a) contacting a gas oil with hydrogen and optional first diluent to form a first liquid feed wherein hydrogen is dissolved in the first liquid feed; (b) contacting the first liquid feed with a first catalyst in a liquid-full hydrotreating reaction zone to produce a first effluent; (c) optionally recycling a portion of the first effluent for use as all or part of the first diluent in step (a); (d) in a separation zone, separating dissolved gases from the portion of the first effluent not recycled in step (c) to produce a separated product; (e) contacting the separated product with hydrogen and optional second diluent to form a second liquid feed, wherein hydrogen is dissolved in the second liquid feed; (f) contacting the second liquid feed with a second catalyst in a liquid-full hydrocracking reaction zone to produce a second effluent; (g) optionally recycling a portion of the second effluent for use as all or part of the second diluent in step (e); and (h) in a refining zone upstream of or downstream from the hydrocracking reaction zone, separating one or more refined products and a heavy oil fraction from (1) the portion of the first effluent not recycled, when the refining zone is upstream of the hydrocracking reaction zone, or (2) the portion of the second effluent not recycled when the refining zone is downstream from the hydrocracking reaction zone; wherein the first catalyst is a hydrotreating catalyst and the second catalyst is a hydrocracking catalyst. In some embodiments of this invention, the process further comprises recovering at least a diesel fraction from the refining zone. In some embodiments of this invention, the process further comprises recovering a diesel fraction and a naphtha fraction from the refining zone.

The hydroprocessing process of this disclosure has at least a hydrotreating reaction zone, a hydrocracking reaction zone and a refining zone. The hydroprocessing reactions of this disclosure take place in liquid-full hydrotreating reaction zone and liquid-full hydrocracking reaction zone.

"Liquid-full", as used herein, refers to a reactor or a reaction zone based on one or more two-phase hydroprocessing units, in which substantially all the hydrogen supplied to a reaction zone is dissolved in a liquid phase, such as the first liquid feed or the second liquid feed, which directly contacts the surface of a solid catalyst. Thus, two phases (liquid and solid) are present in liquid-full reactors or reaction zones. The continuous phase through a liquid-full reactor or reaction zone is liquid.

By "substantially all the hydrogen supplied to a reaction zone is dissolved in a liquid phase" means the volume of gas is no more than 10%, or no more than 5%, or no more than 2% or no more than 1% or no more than 0.5% or less than 0.5%, based on the total volume of the reaction zone. In some embodiments of this invention, essentially no gas phase hydrogen is present in the liquid-full hydrotreating reaction zone and the liquid-full hydrocracking reaction zone.

For clarity, when the term "liquid-full" reactor is used herein, it is meant to include a single reactor or two or more (multiple) reactors in series. Further, when two or more reactors within a reaction zone are in series, each reactor is in liquid communication with a previous or subsequent reactor, as the case may be.

In step (a) of the hydroprocessing process of this disclosure, a gas oil is contacted with a first diluent and hydrogen to form a first liquid feed, wherein the first diluent is optional.

When a first diluent is used, at least a portion of the first diluent is provided by performing optional step (c)—recycling a portion of the first effluent for use as all or part of the first diluent. The gas oil, hydrogen and first diluent may be combined in any order to provide the first liquid feed that is contacted with the first catalyst in the hydrotreating reaction zone. In one embodiment, the gas oil and first diluent are mixed prior to mixing with hydrogen. In another embodiment, gas oil, first diluent and hydrogen are mixed at a single mixing point. In other embodiments, hydrogen is mixed with the gas oil or the first diluent before adding the first diluent or gas oil, respectively. One skilled in the art will appreciate a variety of mixing sequences and combinations can be used.

The first liquid feed is contacted with a first catalyst in a liquid-full hydrotreating reaction zone to produce a first effluent.

Each of the liquid-full hydrotreating reaction zone and liquid-full hydrocracking reaction zone may independently comprise one or more liquid-full reactors in liquid communication, and each liquid-full reactor may independently comprise one or more catalyst beds.

In some embodiments of this invention, in a column reactor or other single vessel containing two or more catalyst beds or between multiple reactors, the beds are physically separated by a catalyst-free zone. In this disclosure, each reactor is a fixed bed reactor and may be of a plug flow, tubular or other design, which is packed with a solid catalyst and wherein the liquid feed is passed through the catalyst.

In some embodiments of this invention, the liquid-full hydrotreating reaction zone comprises two or more catalyst beds disposed in sequence, and the catalyst volume increases in each subsequent catalyst bed. In some embodiments, the ratio of the volume of the catalyst in the first catalyst bed to the volume of the catalyst in the final catalyst bed in the liquid-full hydrotreating reaction zone is in the range of from about 1:1.1 to about 1:20. In some embodiments, the ratio is in the range of from about 1:1.1 to about 1:10. Such two or more catalyst beds can be disposed in a single reactor or in two or more reactors disposed in sequence. As a result, the hydrogen consumption is more evenly distributed among the beds.

When catalyst volume distribution in the liquid-full hydrotreating reaction zone is uneven and catalyst volume increases with each subsequent catalyst bed, the same catalyst and the same volume catalyst provides higher sulfur and nitrogen conversion as compared to an even catalyst volume distribution.

In some embodiments of this invention, the liquid-full hydrotreating reaction zone comprises two or more catalyst beds disposed in sequence, wherein each catalyst bed contains a catalyst having a catalyst volume, and wherein the catalyst volume is distributed among the catalyst beds in a way such that the hydrogen consumption for each catalyst bed is essentially equal. By "essentially equal", it is meant herein that substantially the same amount of hydrogen is consumed in each catalyst bed, within a range of ±10% by volume of hydrogen. One skilled in the art of hydroprocessing will be able to determine catalyst volume distribution to achieve desired essentially equal hydrogen consumption in these catalyst beds.

It was found through experiments that the essentially equal hydrogen consumption in each catalyst bed allows for minimizing the recycle ratio. A reduced recycle ratio results in increased sulfur, nitrogen, metal removal and increased aromatic saturation.

In some embodiments of this invention, hydrogen can be fed between the catalyst beds to increase hydrogen content in the product effluent between the catalyst beds. Hydrogen dissolves in the liquid effluent in the catalyst-free zone so that the catalyst bed is a liquid-full reaction zone. Thus, fresh hydrogen can be added into the feed/diluent (optional)/hydrogen mixture or effluent from a previous reactor or catalyst bed (in series) at the catalyst-free zone, where the fresh hydrogen dissolves in the mixture or effluent prior to contact with the subsequent catalyst bed. A catalyst-free zone in advance of a catalyst bed is illustrated, for example, in U.S. Pat. No. 7,569,136.

In some embodiments of this invention, fresh hydrogen is added between each two catalyst beds. In some embodiments, fresh hydrogen is added at the inlet of each reactor. In some embodiments, fresh hydrogen is added between each two catalyst beds in the liquid-full hydrotreating reaction zone and is also added at the inlet of the liquid-full hydrocracking reaction zone. In some embodiments, fresh hydrogen is added at the inlet of each reactor in the liquid-full hydrotreating reaction zone and is also added at the inlet of the liquid-full hydrocracking reaction zone.

In some embodiments of this invention, the hydrotreating reaction zone has multiple catalyst beds and hydrogen is fed between the beds.

In some embodiments of this invention, the hydrocracking reaction zone has multiple catalyst beds and hydrogen is fed between the beds.

Catalyst is charged to each reactor in a catalyst bed. A single reactor may have one or more catalyst beds. Each catalyst bed, whether within a single reactor or in series in multiple reactors, is physically separated from the other catalyst beds by a catalyst-free zone.

The first catalyst can be any suitable hydrotreating catalyst that results in reducing the sulfur and/or nitrogen content of the hydrocarbon feed under the reaction conditions in the liquid-full hydrotreating reaction zone. In some embodiments of this invention, the suitable hydrotreating catalyst comprises, consists essentially of, or consists of a non-precious metal and an oxide support. In some embodiments of this invention, the metal is nickel or cobalt, or combinations thereof, preferably combined with molybdenum and/or tungsten. In some embodiments, the metal is selected from the group consisting of nickel-molybdenum (NiMo), cobalt-molybdenum (CoMo), nickel-tungsten (NiW) and cobalt-tungsten (CoW). In some embodiments, the metal is nickel-molybdenum (NiMo) or cobalt-molybdenum (CoMo). In some embodiments, the metal is nickel-molybdenum (NiMo). The catalyst oxide support is a mono- or mixed-metal oxide. In some embodiments of this invention, the oxide support is selected from the group consisting of alumina, silica, titania, zirconia, kieselguhr, silica-alumina, and combinations of two or more thereof. In some embodiments, the oxide support comprises, consists essentially of, or consists of an alumina.

The second catalyst is a hydrocracking catalyst. In some embodiments of this invention, the hydrocracking catalyst comprises, consists essentially of, or consists of a non-precious metal and an oxide support. In some embodiments of this invention, the metal is nickel or cobalt, or combinations thereof, preferably combined with molybdenum and/or tungsten. In some embodiments, the metal is selected from the group consisting of nickel-molybdenum (NiMo), cobalt-molybdenum (CoMo), nickel-tungsten (NiW) and cobalt-tungsten (CoW). In some embodiments, the metal is nickel-tungsten (NiW) or cobalt-tungsten (CoW). In some embodiments, the metal is nickel-tungsten (NiW). In some embodiments of this invention, the oxide support is selected from the group consisting of zeolite, alumina, titania, silica, silica-alumina, zirconia, and combinations thereof. In some embodiments, the oxide support is a zeolite support which comprises, consists essentially of, or consists of a zeolite and an oxide. In some embodiments, the oxide is selected from the group consisting of alumina, titania, silica, silica-alumina, zirconia, and combinations thereof. In some embodiments, the oxide support is a zeolite, an amorphous silica, or a combination thereof.

In some embodiments of this invention, the hydrocracking catalyst comprises a hydrotreating catalyst and an amorphous silica or a zeolite or a combination of an amorphous silica and a zeolite. In this aspect, the hydrotreating catalyst is physically (not chemically) mixed with the amorphous silica or zeolite. By "physically mixed" means the hydrotreating catalyst and amorphous silica or zeolite do not react with each other and can be physically separated. The amorphous silica or zeolite is present in an amount of at least 10% by weight, based on the total weight of the hydrocracking catalyst.

The hydrotreating or hydrocracking catalyst used in the process according to the present disclosure may further comprise other materials including carbon, such as activated charcoal, graphite, and fibril nanotube carbon, as well as calcium carbonate, calcium silicate and barium sulfate.

Hydrotreating and hydrocracking catalysts can be in the form of particles, such as shaped particles. By "shaped particle" it is meant the catalyst is in the form of an extrudate. Extrudates include cylinders, pellets, or spheres. Cylinder shapes may have hollow interiors with one or more reinforcing ribs. Trilobe, cloverleaf, rectangular- and triangular-shaped tubes, cross, and "C"-shaped catalysts can be used. In one embodiment, a shaped catalyst particle is about 0.25 to about 13 mm (about 0.01 to about 0.5 inch) in diameter when a packed bed reactor (i.e., fixed bed reactor packed with a solid catalyst) is used. A catalyst particle can be about 0.79 to about 6.4 mm (about 1/32 to about 1/4 inch) in diameter.

Hydrotreating and hydrocracking catalysts are commercially available. Catalyst vendors included, for example, Albemarle, CRI Criterion and Haldor-Topsøe.

Hydrotreating and/or hydrocracking catalysts may be sulfided before use and/or during use in the hydrotreating reaction zone and/or the hydrocracking reaction zone, respectively, by contacting the catalyst with a sulfur-containing compound at an elevated temperature. Suitable sulfur-containing compound include thiols, sulfides, disulfides, $H_2S$, or combinations of two or more thereof. Catalyst may be sulfided before use ("pre-sulfiding") or during the process ("sulfiding") by introducing a small amount of a sulfur-containing compound in the feed or diluent. Catalysts may be pre-sulfided in situ or ex situ. The feed or diluent may be supplemented periodically with added sulfur-containing compound to maintain the catalysts in sulfided condition.

Suitable reaction conditions are selected for the liquid-full hydrotreating reaction zone. Reaction conditions include a temperature of from about 204° C. to about 450° C. In some embodiments, the reaction zone temperature is from about 300° C. to about 450° C., and in some embodiments is from about 300° C. to 400° C. Pressure can range from about 3.45 MPa (about 34.5 bar) to about 17.3 MPa (about 173 bar), and in some embodiments, from about 6.9 to about 13.9 MPa (about 69 to about 138 bar). Suitable catalyst concentration in the hydrotreating reaction zone can be from about 10 to about 50 wt % of the reactor contents for the hydrotreating reaction zone. The first liquid feed is provided at a liquid hourly space velocity (LHSV) of from about 0.1 to about 10 $hr^{-1}$, or from about 0.4 to about 10 $hr^{-1}$, or from about 0.4 to about 4.0 $hr^{-1}$.

The hydrotreated product is the first effluent and the product of the hydrotreating reaction zone. A portion of the first effluent may be recycled for use as all or part of the first diluent.

In the hydrotreating reaction zone, organic nitrogen and organic sulfur are converted to ammonia (hydrodenitrogenation) and hydrogen sulfide (hydrodesulfurization), respectively. In some embodiments of this invention, the first effluent has a nitrogen content no more than about 100 wppm. In some embodiments, the first effluent has a nitrogen content no more than about 50 wppm. In some embodiments, the first effluent has a nitrogen content no more than about 10 wppm.

A separation zone is downstream from the hydrotreating reaction zone. In the separation zone, at least some of the dissolved gases, such as $H_2$, $H_2S$ and $NH_3$, are separated from the portion of the first effluent not recycled (all of the first effluent if no recycle) to produce a separated product. The "portion of the first effluent not recycled" may also be referred to herein as the "remaining portion of the first effluent".

The separation zone may be any gas/liquid separation vessel or apparatus. Examples of gas/liquid separation vessels include a flash, a stripper, a fractionator, or a combination thereof. As will be appreciated by one skilled in the art, a flash or a stripper will be upstream of a fractionator in the combination, so as to remove volatile gases prior to further separation of liquid into one or more refined products and a heavy fraction. In one embodiment of this invention, the separation zone is the refining zone as described in further detail elsewhere herein.

The choice of gas/liquid separation vessel or apparatus, including combinations will depend on the composition of the first effluent. If separation of only dissolved gases is desired, because, for example, only a small amount of naphtha and/or diesel is present in the first effluent, then a flash (low or high pressure) or a stripper may be sufficient. Alternatively, if separation of dissolved gases and liquid refined products are both desired, then a flash (low or high pressure) or a stripper in combination with another separation vessel or apparatus, such as a fractionator may be used. The fractionator enables separation of one or more refined products.

In some embodiments of this invention, the separation zone has a flash, a stripper, a fractionator, or a combination thereof. In some embodiments, the separation zone is a flash or a stripper.

After removing the dissolved gases, the separated product typically has a nitrogen content of less than about 100 parts per million by weight (wppm), or less than about 10 wppm. The separated product typically has a sulfur content of less than about 50 wppm, or less than about 10 wppm. As disclosed in Table 1, a gas oil feed may have a sulfur content of greater than 500 wppm, or greater than 3000 wppm.

The separated product is contacted with hydrogen and optional second diluent to produce a second liquid feed. Hydrogen is dissolved in the second liquid feed. Hydrogen and the separated product and optional second diluent are fed as a single feed (second liquid feed) to a liquid-full reactor in the hydrocracking reaction zone. The separated product, hydrogen and optional second diluent can be combined in any order to provide the second liquid feed that is contacted with the second catalyst in the hydrocracking reaction zone. In one embodiment, the separated product and second diluent are mixed prior to mixing with hydrogen. In another embodiment, separated product, second diluent and hydrogen are mixed at a single mixing point. Other embodiments of mixing sequences include, for example, mixing hydrogen with the separated product or the second diluent before adding the second diluent or separated product, respectively. One skilled in the art will appreciate a variety of mixing sequences and combinations can be used.

Suitable reaction conditions are selected for the liquid-full hydrocracking reaction zone. Reaction conditions are selected to promote desired reactions to convert hydrocarbons in the second liquid feed to diesel fraction while minimizing formation of naphtha fraction. Such desired reactions may include ring opening, carbon-carbon bond breaking, and converting large molecules into smaller molecules.

Hydrocracking reaction zone temperatures can range from about 300° C. to about 450° C. In some embodiments, the reaction zone temperature is from about 300° C. to about 420° C. In some embodiments, the reaction zone temperature is from about 340° C. to about 410° C. Pressure can range from about 3.45 MPa (about 34.5 bar) to about 17.3 MPa (about 173 bar), or from about 6.9 MPa to about 13.9 MPa (about 69 to about 138 bar). Suitable catalyst concentration in the hydrocracking reaction zone can be from about 10 to about 50 wt % of the reactor contents for the hydrocracking reaction zone. The second liquid feed is provided at a liquid hourly space velocity (LHSV) of from about 0.1 to about 10 $hr^{-1}$, or from about 0.4 to about 10 $hr^{-1}$, or from about 0.4 to about 4.0 $hr^{-1}$.

The hydrocracked product is a second effluent and the product of the hydrocracking reaction zone. A portion of the second effluent may be recycled for use as all or part of the second diluent.

When used, the first and second diluent comprise, consist essentially of, or consist of a recycled portion of the first effluent produced in the hydrotreating reaction zone and a recycled portion of the second effluent produced in the hydrocracking reaction zone, respectively. The recycled portion of the first effluent may be combined with the gas oil feed before (one embodiment) or after (another embodiment) contacting the gas oil feed with hydrogen, upstream of the hydrotreating reaction zone. The recycled portion of the second effluent may be combined with the separated product, before (one embodiment) or after (another embodiment) contacting the separated product with hydrogen, upstream of the hydrocracking reaction zone.

In some embodiments of this invention, the optional first diluent is used, a portion of the first effluent is recycled for use as all or part of the first diluent in step (a), and the first diluent comprises, consists essentially of, or consists of a portion of the first effluent.

In some embodiments of this invention, the optional second diluent is used, a portion of the second effluent is recycled for use as all or part of the second diluent in step (e), and the second diluent comprises, consists essentially of, or consists of a portion of the second effluent.

With respect to the first diluent, the portion of the first effluent recycled relative to the portion not recycled, referred to as the "first recycle ratio", may be 0 (i.e., no recycle) or greater than 0, such as, 0.05, or 0.1, or 0.5, or 1, or higher. The first recycle ratio is generally no more than 10, and in some embodiments no more than 8, or no more than 5, or no more than 0.5. In some embodiments of this invention, the first recycle ratio is at least 1.

With respect to the second diluent, the portion of the second effluent recycled relative to the portion not recycled, referred to as the "second recycle ratio", may be 0 (i.e., no recycle) or greater than 0, such as, 0.05, or 0.1, or 0.5, or 1, or higher. The second recycle ratio is generally no more than 10, and in some embodiments no more than 8, or no more than 5, or no more than 0.5. In some embodiments of this invention, the second recycle ratio is at least 1.

In addition to a portion of the first effluent or the second effluent, the first or second diluent, respectively, may comprise any other organic liquid that is compatible with the gas oil hydrocarbon feed, effluents, and catalysts. When the first or second diluent comprises an organic liquid in addition to the recycled effluent, preferably the organic liquid is a liquid in which hydrogen has a relatively high solubility. The first or second diluent may comprise an organic liquid selected from the group consisting of light hydrocarbons, light distillates, naphtha, diesel and combinations of two or more thereof. More particularly, the organic liquid is selected from the group consisting of propane, butane, pentane, hexane or combinations thereof. When the diluent comprises an organic liquid, the organic liquid is typically present in an amount of no greater than 90%, based on the total weight of the gas oil or separated product and diluent, preferably 20-85%, and more preferably 50-80%. Most preferably, when used, the first and second diluents consist of recycled first and second effluents, respectively, which may include dissolved light hydrocarbons. Thus, in some embodiments, the first diluent consists of a recycled portion of the first effluent and the second diluent consists of a recycled portion of the second effluent (i.e., no organic liquid is added to either first or second diluent).

The product from the hydrocracking reaction zone is the second effluent. A portion of the second effluent that is not recycled, that is, the remaining portion of the second effluent, may undergo further treatment, such as, for example, in a refining zone. If none of the second effluent is recycled for use as a diluent, then all of the second effluent may be further treated in a refining zone. Alternatively, at least a portion of the second effluent may be removed as a purge or as a product for use as a feedstock in other refining unit operations, such as, for example feed to a fluid catalyst cracking unit.

In combination with the hydrotreating reaction zone and the hydrocracking reaction zone the process disclosed herein comprises a refining zone. The refining zone may have any vessel or apparatus or a combination of vessels and apparatus capable of separating and removing multiple products. For example, a flash, stripper and/or fractionator, and combinations of two or more thereof may be used. In one embodiment the refining zone has a fractionator (e.g., a distillation column). In one embodiment the refining zone has a combination of (1) a flash or a stripper and (2) a fractionator.

The refining zone may be upstream of or downstream from the hydrocracking reaction zone. The products from the refining zone include one or more refined products and a heavy oil fraction. In some embodiments of this invention, the refining zone is integrated with the hydrocracking reaction zone such that the heavy oil fraction produced in the refining zone is at least part of the feed to the hydrocracking reaction zone.

In some embodiments of this invention, the refining zone is located upstream of the hydrocracking reaction zone. When the refining zone is located upstream of the hydrocracking reaction zone, one or more refined products and a heavy oil fraction can be separated from the portion of the first effluent not recycled.

In some embodiments of this invention, the refining zone is located upstream of the hydrocracking reaction zone, and the separation zone is the refining zone. In such aspect, the portion of the first effluent not recycled is directed into the refining zone wherein gases are removed and one or more refined products and a heavy oil fraction are separated from the portion of the first effluent not recycled. The heavy oil fraction from the refining zone is then fed to the hydrocracking reaction zone. Although the gas removal and the production of one or more refined products and a heavy oil fraction are all accomplished in the refining zone through a single operation, the refining zone may have multiple separation vessels (e.g., a flash or a stripper, and a fractionator) in combination.

The embodiments wherein the refining zone is upstream of the hydrocracking reaction zone and the separation zone is the refining zone can also be described as a process for hydroprocessing a gas oil, the process comprises: (a) contacting a gas oil with hydrogen and optional first diluent to form a first liquid feed wherein hydrogen is dissolved in the first liquid feed; (b) contacting the first liquid feed with a first catalyst in a liquid-full hydrotreating reaction zone to produce a first effluent; (c) optionally recycling a portion of the first effluent for use as all or part of the first diluent in step (a); (d) in a refining zone, separating dissolved gases, one or more refined products and a heavy oil fraction from the portion of the first effluent not recycled in step (c); (e) contacting the heavy oil fraction of step (d) with hydrogen and optional second diluent to form a second liquid feed, wherein hydrogen is dissolved in the second liquid feed; (f) contacting the second liquid feed with a second catalyst in a liquid-full hydrocracking reaction zone to produce a second effluent; and (g) optionally recycling a portion of the second effluent for use as all or part of the second diluent in step (e); wherein the refining zone is upstream of the hydrocracking reaction zone; and wherein the first catalyst is a hydrotreating catalyst and the second catalyst is a hydrocracking catalyst. In some embodiments, the portion of the second effluent not recycled is recovered. In some embodiments, the portion of the second effluent not recycled is further refined to produce one or more refined products and a heavy oil fraction. In some embodiments, the portion of the second effluent not recycled is combined with the portion of the first effluent not recycled upstream of the refining zone. In such aspect, in the refining zone, one or more refined products and a heavy oil fraction are separated from the combined mixture of the portion of the first effluent not recycled and the portion of the second effluent not recycled.

In some embodiments of this invention, the refining zone is located upstream of hydrocracking reaction zone, and the separation zone and the refining zone are different operations. In such aspect, dissolved gases are removed from the portion of the first effluent not recycled in the separation zone to produce a separated product. In some embodiments, the portion of the second effluent not recycled is combined with the portion of the first effluent not recycled upstream of the separation zone to form a combined mixture, and dissolved gases are removed from the combined mixture in the separation zone to produce a separated product. The separated product is introduced into a refining zone in which one or more refined products and a heavy oil fraction are removed from the separated product. The heavy oil fraction from the refining zone is then fed to the hydrocracking reaction zone.

In some embodiments of this invention, the refining zone is located downstream from the hydrocracking reaction zone. When the refining zone is located downstream from the hydrocracking reaction zone, one or more refined products and a heavy oil fraction can be separated from the portion of the second effluent not recycled. Gas/liquid separation may take place in the same unit in which the refined products and the heavy oil fraction are separated. In some embodiments, gas/liquid separation may take place in a different unit than separation of liquids. For example, gas/liquid separation may take place in a flash or a stripper which is disposed upstream of a fractionator wherein liquid products are further separated to produce the refined products and the heavy oil fraction.

In some embodiments of this invention, the refining zone is downstream from the hydrocracking reaction zone and the heavy oil fraction from the refining zone is combined with the portion of the first effluent not recycled or with the separated product upstream of the hydrocracking zone. In some embodiments, the refining zone is downstream from the hydrocracking reaction zone and the heavy oil fraction from the refining zone is combined with the portion of the first effluent not recycled upstream of the separation zone. In some embodiments, the refining zone is downstream from the hydrocracking reaction zone and the heavy oil fraction from the refining zone is combined with the separated product downstream from the separation zone and upstream of the hydrocracking reaction zone.

In one embodiment there is a purge taken from the heavy oil fraction. This purge may be used as a feedstock in other refining unit operations, such as, feedstock to a fluid catalyst cracking unit.

By "one or more refined products" is meant herein to refer to boiling fractions of products separated in the refining zone. More particularly, the one or more refined products may include a naphtha fraction, referred to herein as a distillate volume fraction having a boiling range of from about 30° C. to about 175° C. In the refining zone, light naphtha (distillate volume fraction having a boiling range of from about 30° C. to about 90° C.) and heavy naphtha (distillate volume fraction having a boiling range of from about 90° C. to about 175° C.) may be provided as separate refined products.

Refined products may be separated as gasoline (e.g., a distillate volume fraction having a boiling range of from about 35° C. to about 215° C.) or kerosene (e.g., a distillate volume fraction having a boiling range of from about 150° C. to about 250° C.). It is appreciated that the boiling ranges overlap for refined products, and desired ranges can be selected by ones skilled in the art.

The one or more refined products may include a diesel fraction, referred to herein as a distillate volume fraction having a boiling range of from about 175° C. to about 360° C.

The one or more refined products may include a heating oil, such as a #2 heating oil, referred to herein as a heating oil fraction having a boiling range of from about 150° C. to about 380° C. or up to about 400° C. In some embodiments, the one or more refined products also include a #6 fuel oil having a boiling point greater than about 260° C.

A heavy oil fraction is produced having a boiling point higher than the highest boiling refined product. In some embodiments, the heavy oil fraction has a boiling point of at least 360° C., or at least 380° C. A portion of the heavy oil fraction may be removed as a purge. In the integrated process disclosed herein, at least a portion of the heavy oil fraction is a component of the second liquid feed to the hydrocracking reaction zone.

In some embodiments of this invention, the diesel fraction is at least 50% by volume based on the total volume of the refined products. In some embodiments, the diesel fraction is at least 75% by volume based on the total volume of the refined products. In some embodiments, the diesel fraction is at least 88% by volume based on the total volume of the refined products.

In some embodiments of this invention, the diesel fraction has a density no more than 865 kg/m$^3$, in some embodiments no more than 860 kg/m$^3$, and in some embodiments no more than 845 kg/m$^3$, when measured at a temperature of 15.6° C.

In some embodiments of this invention, the diesel fraction has a nitrogen content no more than about 100 wppm, in some embodiments no more than about 50 wppm, and in some embodiments no more than about 10 wppm.

In some embodiments of this invention, the diesel fraction has a sulfur content no more than about 100 wppm, in some embodiments no more than about 50 wppm, in some embodiments no more than about 20 wppm, and in some embodiments no more than about 10 wppm.

In some embodiments of this invention, the diesel fraction has a cetane index value of at least 35, and in some embodiments at least 40.

It was found through experiments that the process of the present disclosure advantageously converts gas oil to a diesel fraction in high yield. In some embodiments of this invention, the yield of the diesel fraction is at least about 50%. In some embodiments, the yield of the diesel fraction is at least about 60%. In some embodiments, the yield of the diesel fraction is at least about 70%. In some embodiments, the yield of the diesel fraction is at least about 75%. In some embodiments, the yield of the diesel fraction is at least about 80%.

It was also found through experiments that the process of the present disclosure advantageously generates only a small amount of the naphtha fraction. In some embodiments of this invention, the yield of the naphtha fraction is no more than about 15%. In some embodiments, the yield of the naphtha fraction is no more than about 10%. In some embodiments, the yield of the naphtha fraction is no more than about 7%. In some embodiments, the yield of the naphtha fraction is no more than about 5%.

Many aspects and embodiments have been described above and are merely exemplary and not limiting. After reading this specification, skilled artisans appreciate that other aspects and embodiments are possible without departing from the scope of the invention.

DESCRIPTION OF THE FIGURE

FIGS. 1-4 provide illustrations of some embodiments of the gas oil conversion process of this disclosure. Certain detailed features of the proposed process, such as pumps and compressors, separation equipment, feed tanks, heat exchangers, product recovery vessels and other ancillary process equipment are not shown for the sake of simplicity and in order to demonstrate the main features of the process. Such ancillary features will be appreciated by one skilled in the art. It is further appreciated that such ancillary and secondary equipment can be easily designed and used by one skilled in the art without any difficulty or any undue experimentation or invention.

FIG. 1 illustrates an embodiment of the present disclosure in which a hydrocarbon is treated in a hydrotreating reaction zone followed by a hydrocracking reaction zone and then a refining zone.

FIG. 1 shows a hydroprocessing unit 100. Hydroprocessing unit 100 has hydrotreating reaction zone 100A, hydrocracking reaction zone 1008 and refining zone 100C.

Fresh hydrocarbon feed, in this case, a gas oil, is supplied via line 101 and contacted at mixing point 103 with hydrogen supplied via line 102. First diluent is supplied via line 104 and combined with fresh hydrocarbon feed in advance of mixing point 103. First liquid feed is the combination of fresh hydrocarbon, hydrogen and first diluent provided from mixing point 103, which is introduced via line 105 to hydrotreating reactor 106. The arrangement is illustrative and other arrangements may be used for combining hydrocarbon feed, hydrogen and first diluent upstream of hydrotreating reactor 106.

The product of hydrotreating reaction zone 100A is first effluent 107, which exits hydrotreating reactor 106. A portion of first effluent 107 is recycled and used as first diluent and supplied via line 104 to combine with hydrocarbon feed in line 101.

The portion of the first effluent not recycled (remaining portion of the first effluent) is fed via line 108 to separator 109. In separator 109, gases are removed via line 110 and separated product is fed via line 111 to hydrocracking reaction zone 1008.

In hydrocracking reaction zone 1008, separated product from line 111 is combined with hydrogen via line 112 and second diluent via line 114 at mixing point 113. Second liquid feed is the combination of separated product, hydrogen, and second diluent provided from mixing point 113, which is introduced via line 115 to hydrocracking reactor 116. The arrangement is illustrative and other arrangements may be used for combining separated product, hydrogen and second diluent upstream of hydrocracking reactor 116.

The product of hydrocracking reaction zone 1008 is second effluent 117, which exits hydrocracking reactor 116. A portion of second effluent is recycled and used as second diluent and supplied via line 114 to combine with separated product from line 111 at mixing point 113. The portion of the second effluent not recycled (remaining portion of the second effluent) is fed via line 118 to refining zone 100C.

The portion of second effluent not recycled is fed via line 118 to refining zone 100C having a refining apparatus, such as a fractionator 119. In fractionator 119, gases are removed via line 120. Other refined products of varying boiling ranges are removed from fractionator 119 as illustrated through lines 121*a*, 121*b* and 121*c*. Heavy oil fraction is removed from bottom of fractionator 119 through line 122.

Figure 2:
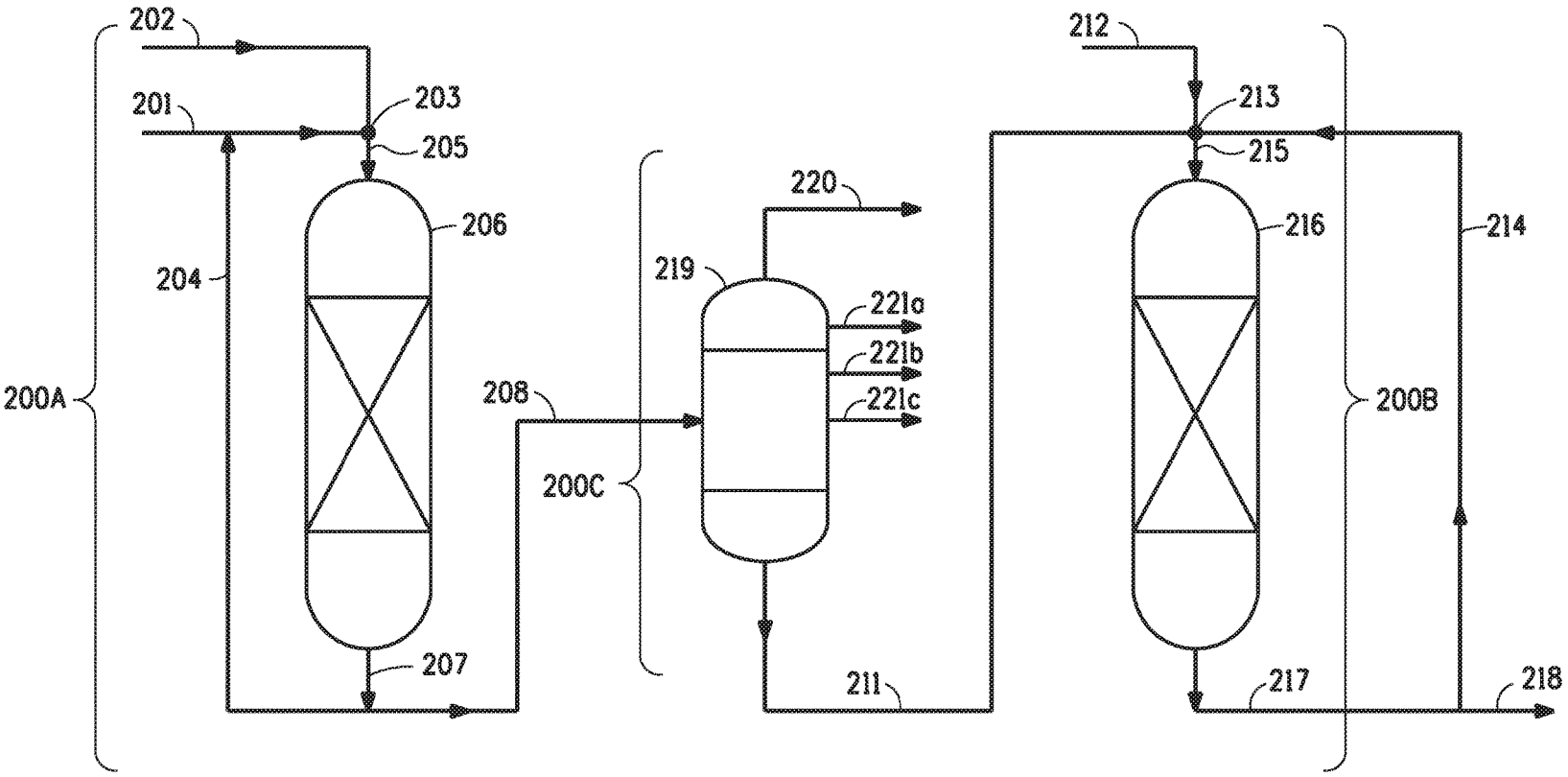
FIG. 2 is a schematic drawing of one embodiment according to the present disclosure having a hydrotreating reaction zone, a hydrocracking reaction zone and a refining zone wherein the refining zone is downstream of the hydrotreating reaction zone and upstream of the hydrocracking reaction zone, and wherein the separation zone is the refining zone.

FIG. 2 illustrates an embodiment of the present disclosure in which a hydrocarbon is treated in a hydrotreating reaction zone followed by a refining zone and then a hydrocracking reaction zone.

FIG. 2 shows a hydroprocessing unit 200. Hydroprocessing unit 200 has hydrotreating reaction zone 200A, hydrocracking reaction zone 200B and refining zone 200C.

Fresh hydrocarbon feed, in this case, a gas oil, is supplied via line 201 and contacted at mixing point 203 with hydrogen supplied via line 202. First diluent is supplied via line 204 and combined with fresh hydrocarbon feed in advance of mixing point 203. First liquid feed is the combination of fresh hydrocarbon, hydrogen and first diluent provided from mixing point 203, which is introduced via line 205 to hydrotreating reactor 206. The arrangement is illustrative and other arrangements may be used for combining hydrocarbon feed, hydrogen and first diluent upstream of hydrotreating reactor 206.

The product of hydrotreating reaction zone 200A is first effluent 207, which exits hydrotreating reactor 206. A portion of first effluent 207 is recycled and used as first diluent and supplied via line 204 to combine with hydrocarbon feed in line 201. The portion of the first effluent not recycled (remaining portion of the first effluent) is fed via line 208 to refining zone 200C having a refining apparatus, such as fractionator 219.

In fractionator 219, gases are removed via line 220. Other refined products of varying boiling ranges are removed from fractionator 219 as illustrated through lines 221*a*, 221*b* and 221*c*. Heavy oil fraction is removed from bottom of fractionator 219 through line 211.

In hydrocracking reaction zone 200B, heavy oil fraction from line 211 is combined with hydrogen via line 212 and second diluent via line 214 at mixing point 213. Second liquid feed is the combination of heavy oil fraction, hydrogen, and second diluent provided from mixing point 213, which is introduced via line 215 to hydrocracking reactor 216. The arrangement is illustrative and other arrangements may be used for combining heavy oil fraction, hydrogen and second diluent upstream of hydrocracking reactor 216.

The product of hydrocracking reaction zone 200B is second effluent 217, which exits hydrocracking reactor 216. A portion of second effluent is recycled and used as second diluent and supplied via line 214 to combine with heavy oil fraction from line 211 at mixing point 213. The portion of the second effluent not recycled (remaining portion of the second effluent) is removed via line 218 as product.

Figure 3:
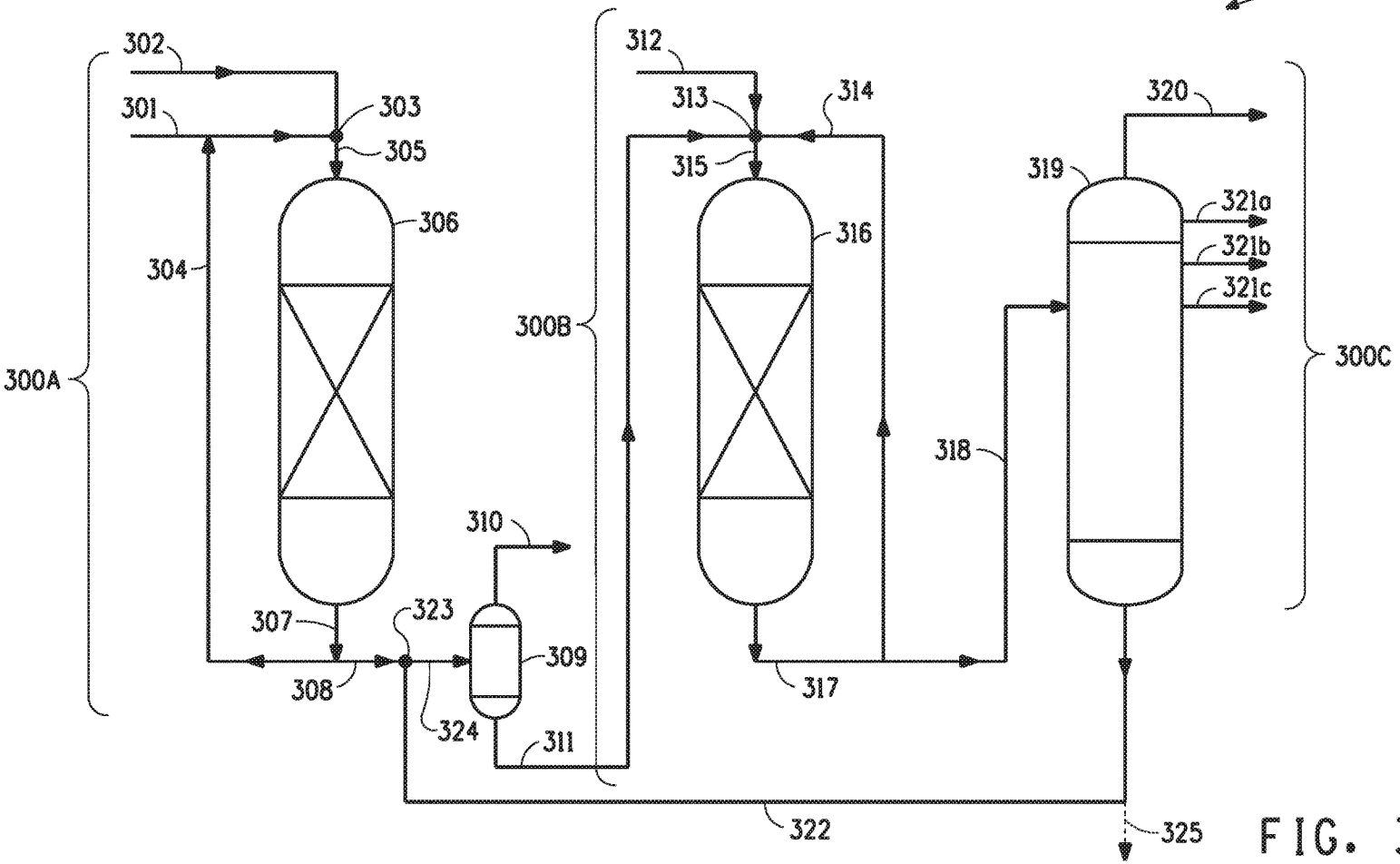
FIG. 3 is a schematic drawing of one embodiment according to the present disclosure having a hydrotreating reaction zone, hydrocracking reaction zone and a refining zone wherein the refining zone is downstream from the hydrocracking reaction zone and wherein the refining zone is integrated with the hydrocracking reaction zone.

FIG. 3 illustrates an embodiment of the present disclosure in which a hydrocarbon is treated in a hydrotreating reaction zone followed by a hydrocracking reaction zone and then a refining zone downstream from the hydrocracking reaction zone with integration of the refining zone with the hydrocracking reaction zone.

FIG. 3 shows a hydroprocessing unit 300. Hydroprocessing unit 300 has hydrotreating reaction zone 300A, hydrocracking reaction zone 300B and refining zone 300C.

Fresh hydrocarbon feed, in this case, a gas oil, is supplied via line 301 and contacted at mixing point 303 with hydrogen supplied via line 302. First diluent is supplied via line 304 and combined with fresh hydrocarbon feed in advance of mixing point 303. First liquid feed is the combination of fresh hydrocarbon, hydrogen and first diluent provided from mixing point 303, which is introduced via line 305 to hydrotreating reactor 306. The arrangement is illustrative and other arrangements may be used for combining hydrocarbon feed, hydrogen and first diluent upstream of hydrotreating reactor 306.

The product of hydrotreating reaction zone 300A is first effluent 307, which exits hydrotreating reactor 306. A portion of first effluent 307 is recycled and used as first diluent and supplied via line 304 to combine with hydrocarbon feed in line 301.

The portion of the first effluent not recycled (remaining portion of the first effluent) in line 308 is combined, at mixing point 323, with heavy oil fraction in line 322 from downstream hydrocracking reaction zone 300B to provide feed in line 324 to separator 309. In separator 309, gases are removed via line 310 and separated product is fed via line 311 to hydrocracking reaction zone 300B.

Separated product from line 311 is combined with hydrogen via line 312 and second diluent via line 314 at mixing point 313 to provide second liquid feed. Second liquid feed is the combination of separated product, hydrogen, and second diluent provided from mixing point 313, which is introduced via line 315 to hydrocracking reactor 316. The arrangement is illustrative and other arrangements may be used for combining separated product, hydrogen and second diluent upstream of hydrocracking reactor 316.

The product of hydrocracking reaction zone 300B is second effluent 317, which exits hydrocracking reactor 316. A portion of second effluent is recycled and used as second diluent and supplied via line 314 to combine with separated product from line 311 at mixing point 313. The portion of the second effluent not recycled is fed via line 318 to refining zone 300C.

The portion of second effluent not recycled is fed via line 318 to refining zone 300C having a refining apparatus, such as fractionator 319. In fractionator 319, gases are removed via line 320. Other refined products of varying boiling ranges are removed from fractionator 319 as illustrated through lines 321*a*, 321*b* and 321*c*. Heavy oil fraction is removed from bottom of fractionator 319 through line 322. A portion of the heavy oil fraction may be recovered as a heavy product by taking a purge from line 325.

Refining zone 300C is integrated with hydrocracking reaction zone 300B by feeding heavy oil fraction from bottom of fractionator 319 through line 322 to combine with the portion of the first effluent not recycled in line 308 in advance of separator 309. Thus heavy oil is subjected to further hydrocracking and generation of higher value products.

Figure 4:
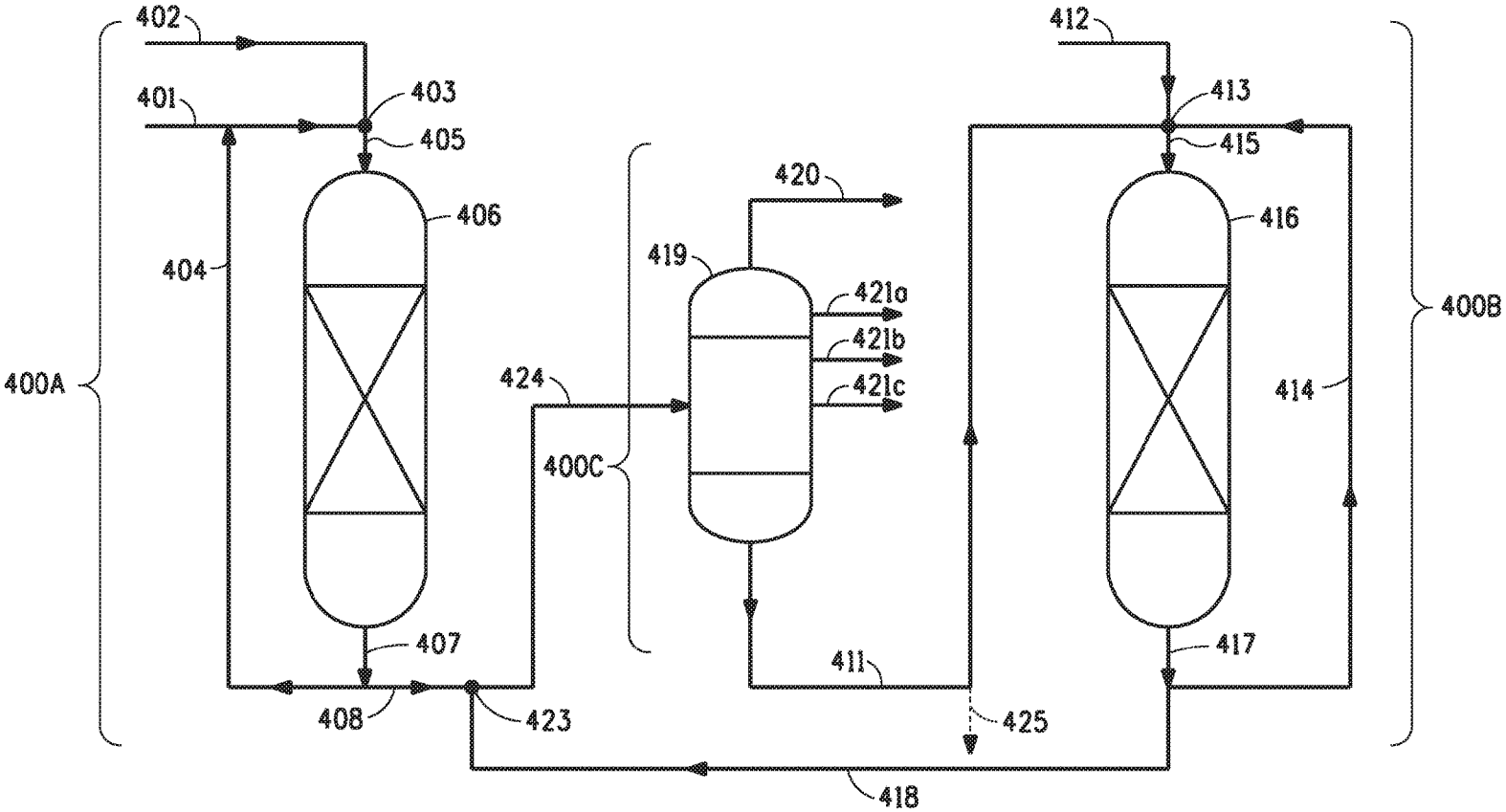
FIG. 4 is a schematic drawing of one embodiment according to the present disclosure having a hydrotreating reaction zone, a hydrocracking reaction zone and a refining zone wherein the refining zone is downstream of the hydrotreating reaction zone and upstream of the hydrocracking reaction zone, wherein the separation zone is the refining zone, and wherein the refining zone is integrated with the hydrocracking zone.

FIG. 4 illustrates an embodiment of the present disclosure in which a hydrocarbon is treated in a hydrotreating reaction zone followed by a hydrocracking reaction zone with a refining zone downstream from the hydrotreating reaction zone and upstream of the hydrocracking reaction zone with integration of the refining zone with the hydrocracking reaction zone.

FIG. 4 shows a hydroprocessing unit 400. Hydroprocessing unit 400 has hydrotreating reaction zone 400A, hydrocracking reaction zone 400B and refining zone 400C.

Fresh hydrocarbon feed, in this case, a gas oil, is supplied via line 401 and contacted at mixing point 403 with hydrogen supplied via line 402. First diluent is supplied via line 404 and combined with fresh hydrocarbon feed in advance of mixing point 403. First liquid feed is the combination of fresh hydrocarbon, hydrogen and first diluent provided from mixing point 403, which is introduced via line 405 to hydrotreating reactor 406. The arrangement is illustrative and other arrangements may be used for combining hydrocarbon feed, hydrogen and first diluent upstream of hydrotreating reactor 406.

The product of hydrotreating reaction zone 400A is first effluent 407, which exits hydrotreating reactor 406. A portion of first effluent 407 is recycled and used as first diluent and supplied via line 404 to combine with hydrocarbon feed in line 401. The portion of the first effluent not recycled (remaining portion of the first effluent) is combined with the second effluent from the bottom of hydrocracking reactor 416 via line 418 at mixing point 423 to provide feed to refining zone 400C via line 424

Refining zone 400C has fractionator 419, in which gases are removed via line 420. Other refined products of varying boiling ranges are removed from fractionator 419 as illustrated through lines 421*a*, 421*b* and 421*c*. Heavy oil fraction is removed from bottom of fractionator 419 through line 411. A portion of the heavy oil fraction may be recovered as a heavy product by taking a purge from line 425.

In hydrocracking reaction zone 400B, heavy oil fraction from line 411 is combined with hydrogen via line 412 and second diluent via line 414 at mixing point 413 to provide second liquid feed. Second liquid feed is the combination of heavy oil fraction, hydrogen, and second diluent provided from mixing point 413, which is introduced via line 415 to hydrocracking reactor 416. The arrangement is illustrative and other arrangements may be used for combining heavy oil fraction, hydrogen and second diluent upstream of hydrocracking reactor 416.

The product of hydrocracking reaction zone 400B is second effluent 417, which exits hydrocracking reactor 416. A portion of second effluent is recycled and used as second diluent and supplied via line 414 to combine with heavy oil fraction from line 411 at mixing point 413. The portion of second effluent not recycled (remaining portion of the second effluent) is fed via line 418 upstream of refining zone 400C.

Hydrocracking reaction zone 400B is integrated with refining zone 400C by introducing the portion of the second effluent not recycled from the bottom of hydrocracking reactor 416 through line 418 to combine with the portion of the first effluent not recycled in line 408 upstream of refining zone 400C (and fractionator 419). Thus after hydrocracking, the portion of the second effluent not recycled is subjected to further refining and recovery of refined products.

EXAMPLES

The concepts described herein will be further described in the following examples, which do not limit the scope of the invention described in the claims.

Analytical Methods and Terms

ASTM Standards. All ASTM Standards are available from ASTM International, West Conshohocken, Pa., www.astm.org.

Amounts of sulfur and nitrogen are provided in parts per million by weight, wppm.

Total Sulfur was measured using ASTM D4294 (2008), "Standard Test Method for Sulfur in Petroleum and Petroleum Products by Energy Dispersive X-ray Fluorescence Spectrometry," DOI: 10.1520/D4294-08 and ASTM D7220 (2006), "Standard Test Method for Sulfur in Automotive Fuels by Polarization X-ray Fluorescence Spectrometry," DOI: 10.1520/D7220-06.

Total Nitrogen was measured using ASTM D4629 (2007), "Standard Test Method for Trace Nitrogen in Liquid Petroleum Hydrocarbons by Syringe/Inlet Oxidative Combustion and Chemiluminescence Detection," DOI: 10.1520/D4629-07 and ASTM D5762 (2005), "Standard Test Method for Nitrogen in Petroleum and Petroleum Products by Boat-Inlet Chemiluminescence," DOI: 10.1520/D5762-05.

Boiling range distribution (Table 2) was determined using ASTM D2887 (2008), "Standard Test Method for Boiling Range Distribution of Petroleum Fractions by Gas Chromatography," DOI: 10.1520/D2887-08.

Density, Specific Gravity and API Gravity were measured using ASTM Standard D4052 (2009), "Standard Test Method for Density, Relative Density, and API Gravity of Liquids by Digital Density Meter," DOI: 10.1520/D4052-09.

"API gravity" refers to American Petroleum Institute gravity, which is a measure of how heavy or light a petroleum liquid is compared to water. If API gravity of a petroleum liquid is greater than 10, it is lighter than water and floats; if less than 10, it is heavier than water and sinks. API gravity is thus an inverse measure of the relative density of a petroleum liquid and the density of water, and is used to compare relative densities of petroleum liquids.

The formula to obtain API gravity of petroleum liquids from specific gravity (SG) is:

$$\text{API gravity}=(141.5/SG)-131.5$$

"LHSV" means liquid hourly space velocity, which is the volumetric rate of the liquid feed divided by the volume of the catalyst, and is given in $hr^{-1}$.

"WABT" means weighted average bed temperature.

The following examples are presented to illustrate specific embodiments of the present invention and not to be considered in any way as limiting the scope of the invention.

Example 1 and Comparative Examples A-D

The properties of a gas oil (GO) from a commercial refinery used in Example 1 and Comparative Examples A-D are provided in Table 2. This GO was hydrotreated at the refinery to lower the sulfur and nitrogen content and the hydrotreated product had the properties provided in Table 3, after removal of dissolved ammonia and hydrogen sulfide and other low boiling hydrocarbons (such as naphtha) in a separation (fractionation) step. This reduced-sulfur and reduced-nitrogen hydrotreated GO—"separated GO" was used as feed for a hydrocracking reaction zone.

The separated GO was hydrocracked in an experimental pilot unit containing one fixed bed liquid-full reactor. Comparative Examples were performed with addition of dodecylamine (to simulate ammonia) and/or hydrogen sulfide.

The reactor used for hydrocracking in the Example 1 and Comparative Examples A-D was of 19 mm (¾") OD 316 L stainless steel tubing and about 49 cm (19¼") in length with reducers to 6 mm (¼") on each end. Both ends of the reactor were first capped with metal mesh to prevent catalyst leakage. Below the metal mesh, the reactor was packed with layers of 1 mm glass beads at both ends. Catalyst was packed in the middle section of the reactor.

TABLE 2

Properties of a Gas Oil before Hydrotreating

| Property | Unit | Value |
|---|---|---|
| Sulfur | wppm | 20750 |
| Nitrogen | wppm | 1807 |
| Density at 15.6° C. (60° F.) | g/ml | 0.9364 |
| API Gravity | | 19.5 |

Boiling Point Distribution

| | Simulated Distillation, wt % | ° C. (° F.) |
|---|---|---|
| IBP = Initial boiling point | IBP | 218 (424) |
| | 5 | 323 (614) |
| | 10 | 346 (655) |
| | 20 | 372 (701) |
| | 30 | 392 (737) |
| | 40 | 411 (771) |
| | 50 | 430 (806) |
| | 60 | 450 (841) |
| | 70 | 473 (883) |
| | 80 | 500 (933) |
| | 90 | 537 (999) |
| | 95 | 563 (1046) |
| | 99 | 597 (1107) |
| FBP = Final boiling point | FBP | 602 (1115) |

TABLE 3

Properties of Separated GO (after fractionation)

| Property | Unit | Value |
|---|---|---|
| Sulfur | wppm | 47 |
| Nitrogen | wppm | 77 |
| Density at 15.6° C. (60° F.) | g/ml | 0.8598 |
| API Gravity | | 32.9 |

Boiling Point Distribution

| | Simulated Distillation, wt % | ° C. (° F.) |
|---|---|---|
| IBP = Initial boiling point | IBP | 109 (228) |
| | 5 | 287 (548) |
| | 10 | 328 (623) |
| | 20 | 366 (691) |
| | 30 | 392 (737) |
| | 40 | 414 (777) |
| | 50 | 434 (813) |
| | 60 | 455 (852) |
| | 70 | 485 (905) |
| | 80 | 525 (977) |
| | 90 | 563 (1045) |
| | 95 | 585 (1084) |
| | 99 | 614 (1137) |
| FBP = Final boiling point | FBP | 618 (1145) |

The reactor contained a hydrocracking catalyst for boiling point conversion and density reduction (API shift). About 75 ml of catalyst was loaded in the reactor. The catalyst, TK-943, was a NiW on SiAl/zeolite support from Haldor Topsøe, Houston, Tex. It was in the form of extrudates of a cylindrical shape of about 1.6 mm diameter. The reactor was packed with layers of 5 ml (bottom) and 5 ml (top) of glass beads.

The reactor was placed in a temperature controlled sand bath in a 7.6 cm (3") OD and 120 cm long pipe filled with fine silicon carbide. Temperature was monitored at the inlet and outlet of the reactor as well as in the sand bath. The temperature in the reactor was controlled using heat tape wrapped around the 3" OD pipe and connected to temperature controllers. After exiting the reactor, the effluent was split into a recycle portion and a portion not recycled (or a remaining portion). The recycle portion flowed through a piston metering pump, to join fresh hydrocarbon feed at the inlet of the reactor. The recycle ratio was 3.

Hydrogen was fed from compressed gas cylinders and the flow rate was measured using a mass flow controller. The hydrogen was injected and mixed with the combined fresh separated GO feed and the recycle portion upstream of the reactor. The combined "fresh separated GO/hydrogen/recycle portion" feed flowed downwardly through a first temperature-controlled sand bath in a 6 mm OD tubing and then in an up-flow mode through the reactor.

In Example 1 and Comparative Examples A-D, the hydrocracking catalyst was dried ex-situ in an oven at 121° C. Then the catalyst was charged to the reactor as described above. The catalyst was maintained overnight at 115° C. under a total flow of 70 standard cubic centimeters per minute (sccm) of hydrogen at 1.7 MPa (17 bar). The temperature was increased to 149° C. with hydrogen flow only, and then the pressure was increased to 6.9 MPa (69 bar) by filling the system with charcoal lighter fluid. The charcoal lighter fluid was spiked with a sulfur agent (1 wt % sulfur, added as 1-dodecanethiol) used to pre-sulfide the catalyst. The catalyst-charged reactor was slowly heated to 232° C. in three hours with a flow of hydrogen at 140 sccm and a flow of sulfur-spiked charcoal lighter fluid at 4 ml/minute (3.2 $hr^{-1}$ LHSV) through the catalyst bed.

The system was held steady for three hours before the charcoal lighter fluid feed was switched to sulfur and nitrogen-spiked charcoal lighter fluid. The nitrogen spiking agent (300 wppm nitrogen, added as acridine) was to stabilize the hyper-activity of the catalyst at higher temperatures in the pre-sulfiding process. The reactor temperature was ramped gradually to 349° C. in five hours. Then the reactor temperature was raised to 371° C. in one hour for high temperature pre-sulfiding followed by cooling back to 349° C., where pre-sulfiding was continued until a breakthrough of hydrogen sulfide ($H_2S$) at the outlet of the reactor occurred. After pre-sulfiding, the catalyst was stabilized by flowing a straight run diesel (SRD) feed through the catalyst bed at 349° C. and 6.9 MPa (1000 psig or 69 bar) for 8 hours.

After pre-sulfiding and stabilizing the catalyst, separated GO hydrocarbon feed was pre-heated to 60° C. and was pumped to the reactor using a syringe pump at a standard flow rate of 2.5 ml/minute for a hydrocracking LHSV of 2 $hr^{-1}$. Hydrogen feed rate was 58 normal liters per liter (N l/l) of hydrocarbon feed (321 scf/bbl). The reactor had a weighted average bed temperature or WABT of 371° C. Pressure was 13.8 MPa (138 bar). The recycle ratio was 3.

The pilot unit was kept at these conditions for an additional 10-12 hours to assure that the catalyst was fully precoked and the system was lined-out while testing product samples for total sulfur, total nitrogen, and bulk density.

For Example 1 and Comparative Examples A-D, hydrogen feed rate was 71 normal liters per liter (N l/l) of fresh hydrocarbon feed (395 scf/bbl). The reactor had a weighted average bed temperature (WABT) of 404° C. Pressure was 13.8 MPa (138 bar). The pilot unit was kept at these conditions for each Example for four to six hours to assure that the system was lined-out while testing product samples for both total sulfur, total nitrogen, and density. The recycle ratio (RR) was 3. The liquid feed (separated GO) and constant process parameters are provided in Table 4.

For Example 1, the separated GO was hydrocracked as is to simulate the removal of ammonia. For Comparative Examples A-D, different levels of nitrogen doping with dodecylamine (477, 960, 1498 wppm nitrogen, respectively) were introduced to the separated GO. Dodecylamine converts to ammonia under process conditions. The doped separated GO was hydrocracked under the same conditions as Example 1 in order to expose the catalyst to different concentrations of ammonia.

For Comparative Example D, the hydrotreated GO was doped with both nitrogen and sulfur (added as 1-dodecanethiol), and the doped hydrotreated GO was hydrocracked under the same conditions as Examples and Comparative Examples A-C.

A Total Liquid Product (TLP) sample and an off-gas sample were collected for each Example under the steady state conditions. The TLP analysis results are provided in Table 5.

The separated GO in Example 1, based on the present disclosure shows the effect of low nitrogen and low sulfur (as well as less low boiling fraction) on yield after hydrocracking. In Comparative Examples A-D, the hydrotreated GO was hydrocracked with different levels of nitrogen and sulfur doping to expose the hydrocracking catalyst to different concentrations of ammonia and hydrogen sulfide.

As can be seen in Table 5, hydrocracking activity of the catalyst was improved in Example 1 relative to Comparative Examples A-D, as manifested in greater density reduction, hydrogen consumption, and boiling point conversion. In Comparative Examples A-D, increasing concentrations of nitrogen doping were introduced to the low-nitrogen hydrotreated GO. The lower catalyst activity was seen in the decreasing density reduction, hydrogen consumption, and boiling point conversion.

For Comparative Example D, the hydrotreated GO was doped with about 0.5 wt % sulfur in addition to similar nitrogen concentration as Comparative Example B. Comparative Example D shows that hydrogen sulfide byproduct had significantly low (to no) effect on hydrocracking catalyst activity compared with ammonia.

TABLE 4

Constant Parameters for Example 1 and Comparative Examples A-D

| | Pressure (MPa) | WABT (° C.) | LHSV ($hr^{-1}$) | RR | Density (g/ml) | Sulfur wppm | Nitrogen wppm | Diesel Fraction (wt %) |
|---|---|---|---|---|---|---|---|---|
| Process | 13.8 | 404 | 2 | 3 | | | | |
| Feed | | | | | 0.8598 | 47 | 77 | 14 |

RR is recycle ratio.

Density was measured at 15.6° C.

TABLE 5

Summary of Results for Example 1 and Comparative Examples A-D

| Example | Feed Nitrogen Doping (wppm) | Feed Sulfur Doping (wppm) | Density (g/ml) | Sulfur (wppm) | Nitrogen (wppm) | $H_2$ Cons. N l/l (scf/bbl) | Diesel Fraction (wt %) |
|---|---|---|---|---|---|---|---|
| Feed | | | 0.8598 | 47 | 77 | | 14 |
| 1 (No Feed Doping) | None | None | 0.8216 | 6 | 9 | 54 (304) | 52 |

TABLE 5-continued

Summary of Results for Example 1 and Comparative Examples A-D

| Example | Feed Nitrogen Doping (wppm) | Feed Sulfur Doping (wppm) | Density (g/ml) | Sulfur (wppm) | Nitrogen (wppm) | $H_2$ Cons. N l/l (scf/bbl) | Diesel Fraction (wt %) |
|---|---|---|---|---|---|---|---|
| Comp. A | 477 | None | 0.8372 | 5 | 10 | 35 (196) | 34 |
| Comp. B | 960 | None | 0.8458 | 6 | 16 | 14 (78) | 22 |
| Comp. C | 1498 | None | 0.8493 | 6 | 17 | 14 (77) | 22 |
| Comp. D | 806 | 5398 | 0.8421 | 11 | 13 | 16 (87) | 29 |

Density was measured at 15.6° C.

$H_2$ Cons. means hydrogen consumption rate.

Examples 2-5

Processes disclosed herein and shown in FIGS. 1-4 were simulated in Examples 2-5, respectively, using Aspen HYSYS® process modeling system, available from Aspen Technology, Inc., Cambridge, Mass.

As in Example 1 above, the Separated GO with properties set forth above in Table 3 was used as feed for the hydrocracking reaction zone in these simulations. For the simulation, process conditions as set forth above for Example 1 and Comparative Examples A-D were assumed.

Example 2

As shown in FIG. 1, a process is disclosed wherein a gas oil hydrocarbon feed is mixed with a first diluent and hydrogen upstream of a hydrotreating reactor to provide a first liquid feed. In the hydrotreating reactor, the first liquid feed is hydrotreated to provide a first effluent. A portion of the first effluent is recycled and used as the first diluent. The recycle ratio is 3. Downstream of the hydrotreating reactor, in a separation zone, gases are removed from the portion of the first effluent not recycled and a separated (liquid) product is produced. The separated product (assuming the same properties as the Separated GO) is mixed with hydrogen and a second diluent upstream of a hydrocracking reactor to provide a second liquid feed. In the hydrocracking reactor, the second liquid feed is hydrocracked to provide a second effluent. A portion of the second effluent is recycled and used as the second diluent. The recycle ratio is 3. Downstream of the hydrocracking reactor, in a refining zone that is a distillation column, gases, and refined products and a heavy oil fraction are removed from the portion of the second effluent not recycled. A heavy oil fraction is removed from the bottom of the column. Results are provided in Table 6.

Example 3

The process of Example 3 is shown in FIG. 3. Example 3 was performed similarly to Example 2, but with the addition of integrating the refining zone downstream of the hydrocracking reaction zone with the hydrocracking reaction zone by recycling the heavy oil fraction for use as a portion of the feed to the hydrocracking reaction zone by mixing with the portion of first effluent not recycled in advance of the separation zone. Results are provided in Table 6.

Example 4

As shown in FIG. 2, a process is disclosed wherein a gas oil hydrocarbon feed is mixed with a first diluent and hydrogen upstream of a hydrotreating reactor to provide a first liquid feed. In the hydrotreating reactor, the first liquid feed is hydrotreated to provide a first effluent. A portion of the first effluent is recycled and used as the first diluent. The recycle ratio is 3. Downstream of the hydrotreating reactor, is a separation zone, which, in this Example 4 and the following Example 5 is a refining zone. In the refining zone, gases and refined products are removed from the portion of the first effluent not recycled and a heavy oil fraction is produced. The heavy oil fraction (assuming the same properties as the Separated GO) is mixed with hydrogen and a second diluent upstream of a hydrocracking reactor to provide a second liquid feed. In the hydrocracking reactor, the second liquid feed is hydrocracked to provide a second effluent. A portion of the second effluent is recycled and used as the second diluent. The portion of the second effluent not recycled is recovered and further refined (not illustrated in FIG. 2) to produce refined products and a heavy oil fraction. The refined products and the heavy oil fraction generated from the portion of the second effluent not recycled are reported in Table 6.

Example 5

The process of Example 5 is shown in FIG. 4. Example 5 was performed similarly to Example 4, but with the addition of integrating the refining zone upstream of the hydrocracking reaction zone with the hydrocracking reaction zone by feeding the hydrocracked product from the hydrocracking reaction zone to the refining zone by mixing with the portion of the first effluent not recycled in advance of the refining zone. Results are provided in Table 6.

TABLE 6

Results for Simulated Examples

| Example | Naphtha Fraction, wt % | Diesel Fraction, wt % | Heavy Oil Fraction, wt % |
|---|---|---|---|
| 2 | 4 | 57 | 39 |
| 3 | 4 | 72 | 24 |
| 4 | <1 | 59 | 40 |
| 5 | 2 | 80 | 18 |

Table 6 shows Examples 2-5 provide at least 50% diesel fraction and correspondingly low amounts of naphtha fraction.

Table 6 also shows when the hydrocracking reaction zone is integrated with the refining zone (Examples 3 and 5), much higher yields of the diesel fraction are achieved, with significant reduction of the heavy oil fraction.

In Example 5, high yield of the diesel fraction is achieved when not only the refining zone is upstream from the hydrocracking reaction zone, so that the products from both the hydrotreating reaction zone and the hydrocracking reaction zone are separated and only the heavy oil fraction is fed to the hydrocracking reaction zone, but also a portion of the product of the hydrocracking reaction zone is sent back to the refining zone. Since a portion of product from the hydrotreating reaction zone is removed in the refining zone as naphtha and diesel fractions, the hydrocracking reactor may be sized smaller and still achieve improvements in diesel yield.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification is to be regarded in an illustrative rather than a restrictive sense, and all such modifications are intended to be included within the scope of invention.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

It is to be appreciated that certain features are, for clarity, described herein in the context of separate embodiments, may also be provided in combination in a single embodiment. Conversely, various features that are, for brevity, described in the context of a single embodiment, may also be provided separately or in any subcombination.

What is claimed is:

1. A process for hydroprocessing a gas oil, comprising:

(a) contacting a gas oil with hydrogen and optional first diluent to form a first liquid feed wherein hydrogen is dissolved in the first liquid feed;

(b) contacting the first liquid feed with a first catalyst in a liquid-full hydrotreating reaction zone to produce a first effluent;

(c) optionally recycling a portion of the first effluent for use as all or part of the first diluent in step (a);

(d) in a separation zone, separating dissolved gases from the portion of the first effluent not recycled in step (c) to produce a separated product;

(e) contacting the separated product with hydrogen and optional second diluent to form a second liquid feed, wherein hydrogen is dissolved in the second liquid feed;

(f) contacting the second liquid feed with a second catalyst in a liquid-full hydrocracking reaction zone to produce a second effluent;

(g) optionally recycling a portion of the second effluent for use as all or part of the second diluent in step (e); and (h) in a refining zone downstream from the hydrocracking reaction zone, separating one or more refined products and a heavy oil fraction from the portion of the second effluent not recycled;

wherein the first catalyst is a hydrotreating catalyst and the second catalyst is a hydrocracking catalyst; wherein the one or more refined products includes a diesel fraction, and the yield of the diesel fraction is at least about 50%; and wherein the second liquid feed is a combination of the separated product, hydrogen and optional second diluent and is fed as a single feed to the liquid-full hydrocracking reaction zone.

2. The process of claim 1 wherein the second catalyst comprises a non-precious metal and an oxide support.

3. The process of claim 1 wherein the optional first diluent is used, and the first diluent consists of a portion of the first effluent with a first recycle ratio ranging from 1 to 10.

4. The process of claim 1 wherein the optional second diluent is used, and the second diluent consists of a portion of the second effluent with a second recycle ratio ranging from 1 to 10.

5. The process of claim 1 wherein the separation zone comprises a flash, a stripper, a fractionator, or a combination thereof, and the refining zone comprises a fractionator.

6. The process of claim 1 wherein the one or more refined products includes a naphtha fraction, and the yield of the naphtha fraction is no more than about 10%.

7. The process of claim 1 wherein the first effluent has a nitrogen content no more than about 100 wppm.

8. A process for hydroprocessing a gas oil, comprising:

(a) contacting a gas oil with hydrogen and optional first diluent to form a first liquid feed wherein hydrogen is dissolved in the first liquid feed;

(b) contacting the first liquid feed with a first catalyst in a liquid-full hydrotreating reaction zone to produce a first effluent;

(c) optionally recycling a portion of the first effluent for use as all or part of the first diluent in step (a);

(d) in a refining zone, separating dissolved gases, one or more refined products and a heavy oil fraction from the portion of the first effluent not recycled;

(e) contacting the heavy oil fraction of step (d) with hydrogen and optional second diluent to form a second liquid feed, wherein hydrogen is dissolved in the second liquid feed;

(f) contacting the second liquid feed with a second catalyst in a liquid-full hydrocracking reaction zone to produce a second effluent; and (g) optionally recycling a portion of the second effluent for use as all or part of the second diluent in step (e);

wherein the first catalyst is a hydrotreating catalyst and the second catalyst is a hydrocracking catalyst; wherein the one or more refined products includes a diesel fraction, and the yield of the diesel fraction is at least about 50%; and wherein the second liquid feed is a combination of the heavy oil fraction of step (d), hydrogen and optional second diluent and is fed as a single feed to the liquid-full hydrocracking reaction zone.

9. The process of claim 8 wherein the second catalyst comprises a non-precious metal and an oxide support.

10. The process of claim 8 wherein the optional first diluent is used, and the first diluent consists of a portion of the first effluent with a first recycle ratio ranging from 1 to 10.

11. The process of claim 8 wherein the optional second diluent is used, and the second diluent consists of a portion of the second effluent with a second recycle ratio ranging from 1 to 10.

12. The process of claim 8 wherein the refining zone comprises a fractionator in combination with a flash or a stripper.

13. The process of claim 8 wherein the one or more refined products includes a naphtha fraction, and the yield of the naphtha fraction is no more than about 10%.

14. The process of claim 8 wherein the first effluent has a nitrogen content no more than about 100 wppm.

15. The process of claim 8 wherein the one or more refined products includes a naphtha fraction, and the yield of the naphtha fraction is no more than about 5%.

16. The process of claim 2 wherein the non-precious metal is nickel-tungsten (NiW) or cobalt-tungsten (CoW).

17. The process of claim 9 wherein the non-precious metal is nickel-tungsten (NiW) or cobalt-tungsten (CoW).

* * * * *